United States Patent [19]

Jenkins et al.

[11] Patent Number: 4,591,360

[45] Date of Patent: May 27, 1986

[54] DECORATING METAL CAN CONTAINERS FROM FLEXIBLE TRANSFER PAPER CARRIER WHICH IS HEATED TO SHRINK ONTO CAN

[75] Inventors: Leonard A. Jenkins, Kirtlington; Terence A. Turner, Frilford Heath, both of United Kingdom

[73] Assignee: Metal Box plc, United Kingdom

[21] Appl. No.: 732,756

[22] PCT Filed: Aug. 30, 1984

[86] PCT No.: PCT/GB84/00301

§ 371 Date: May 2, 1985

§ 102(e) Date: May 2, 1985

[87] PCT Pub. No.: WO85/01018

PCT Pub. Date: Mar. 14, 1985

[30] Foreign Application Priority Data

Sep. 2, 1983 [GB] United Kingdom ..... 3323563

[51] Int. Cl.[4] ..... B41M 1/28; B44C 1/17

[52] U.S. Cl. ..... 8/471; 8/522; 427/287

[58] Field of Search ..... 8/471, 522

[56] References Cited

U.S. PATENT DOCUMENTS 4,465,489 8/1984 Jenkins et al. ..... 8/471

*Primary Examiner*—A. Lionel Clingman

*Attorney, Agent, or Firm*—Diller, Ramik & Wight

[57] ABSTRACT

In a method in which containers, such as cylindrical metal cans, are printed by means of dye diffusion transfer, from a flexible paper carrier which is heated to shrink the carrier into intimate contact with a dye receptive coating on the surface of the container, and to effect dye transfer, the carrier has a weight of 35–110 grams per square meter, an equilibrium moisture content of 2–15% when exposed to air with a relative humidity of 50%, and is applied to the container so that the direction of grain of the paper is parallel to the axis of symmetry passing through the center of the base of the container.

8 Claims, No Drawings

DECORATING METAL CAN CONTAINERS FROM FLEXIBLE TRANSFER PAPER CARRIER WHICH IS HEATED TO SHRINK ONTO CAN

The present invention relates to methods of decorating containers by dye diffusion transfer, such as those described and claimed in co-pending UK patent application No. 8121726, filed on July 14, 1981. In such methods, for example, in respect of cylindrical metal containers, a flexible carrier printed with indicia in a sublimible dye, is applied over a coating receptive to such a dye on the cylindrical surface of the container and the carrier held in intimate contact with the coating whilst the container and carrier are heated, so that at least some of the dye migrates by sublimation to the coating. The carrier is then removed from the container.

In particular, a flexible paper carrier is applied over the receptive coating and held in position either directly or indirectly by means of an adhesive, the container and carrier then being heated whilst the carrier is in position at such a temperature and for such a time that the carrier freely shrinks into intimate contact with the coating, and at least some of the dye sublimes so as to transfer the indicia to the coating.

An important consequence of the use of an adhesive to hold the paper carrier in contact with the receptive coating is that the required intimate contact between carrier and coating is achieved by converting into a useful feature what may otherwise be a disadvantage, namely, the fact that the paper shrinks due to loss of moisture as a result of being heated to effect the dye transfer process. This results in considerably improved contact between the carrier and the coated container surface, as compared with previously proposed arrangements where the contact relies on the external application of pressure whilst heating to effect dye transfer.

In the present invention the applicants have found that the intimacy of contact between the paper carrier and the receptive coating on the container body is of considerable importance in determining the quality of the transferred indicia, i.e. the closer the contact between the carrier and the receptive coating the sharper the definition of the transferred image.

The applicants have also found, to their surprise, that very close contact between the paper carrier and the receptive coating can be achieved by (1) a careful selection of the properties of the carrier material and (2) the orientation of the carrier with respect to the container.

Thus, according to the present invention there is provided a method of decorating containers including the steps of:

(a) applying a flexible paper carrier, printed with indicia in a sublimible dye, over a coating receptive to such dye on a surface of the container, by means of an adhesive such as to be removable without damage to the coating, and (b) heating the container whilst the carrier is held to it, at such a temperature and for such a time that the carrier freely shrinks into intimate contact with the coating and at least some of the dye sublimes so as to transfer the indicia to the coating.

in which the paper carrier has a weight of 35–110 grams per square meter, an equilibrium moisture content of 2–15% when exposed to air with a relative humidity of 50%, and is applied to the coating on the surface of the container so that the direction of grain of the paper is parallel to the axis of symmetry passing through the centre of the base of the container.

The expression "direction of grain of the paper" refers to the direction of the paper in which there is primarily a greater degree of alignment of consitituent fibres. The direction of grain is related to the direction of travel of a paper-making machine, which results in a relatively high ratio of orientation of fibres in the direction of the machine compared with fibres in the cross machine direction.

Preferably, the weight of the paper carrier is 50–100 grams per square meter and its equivalent moisture content 4–10% when exposed to air with a relative humidity of 50%. (BS 3433: 1961).

Desirably, the thickness of the paper carrier is from 30–100 $\mu$m.

It has also been found that the ratio of the dry tearing strength of the paper carrier in the cross grain direction to that in the machine grain direction is important in selecting paper for use as carrier material, and advantageously the ratio should lie in the range of 1.2–2.0. Preferably, the ratio should be in the range of 1.35–1.6. Tearing strength may be measured using an Elmendorf Tear Tester (BS 4468: 1969).

The surface roughness of the paper carrier is also relevant to the practice of the present invention, since the smoother the paper surface, the closer the contact between the carrier and the container surface. The property may be measured by the Bendtsen paper roughness test (BS 4420: 1969) and desirably should fall in the range of 20–500 ml of air per minute, preferably 30–150 ml of air per minute.

By selecting a paper carrier possessing the properties identified above and applying it to the receptive coating of a container in the manner described, it has been found that the carrier shrinks on heating into very close contact with the coating resulting in the transfer of indicia without any noticeable loss of clarity or sharpness.

The carrier is applied over the receptive coating by means of an adhesive, either in the manner of a 360° wrap around label with a narrow overlapping strip to which the adhesive is applied (i.e. the adhesive may be present solely between the overlapping strips, or between the overlapping strips and between the underlying strip and the receptive coating), or where there is no overlap, by the application of adhesive to the undersurface of the carrier, preferably in the form of two or more adhesive strips parallel to the direction of grain of the paper. In the latter circumstance the carrier may cover only a portion of the receptive coating.

An adhesive may be applied over a greater surface area of the carrier, but there must be sufficient residual freedom of movement of the carrier for it to shrink into intimate contact with the receptive coating without splitting or tearing. Thus, the primary purpose of the adhesive is to hold the carrier in position on the receptive coating of the container and to restrain its overall movement on shrinkage so that it contracts into intimate contact with the receptive coating. Adhesive substances suitable for this purpose are described in UK patent application No. 8121726.

The deliberate application of the carrier in the manner proposed with its grain direction parallel to the axis of symmetry passing through the centre of the base of the container is in clear contra-distinction to the teachings of the related container labelling art, as evinced by, for example, Krones Manual of Labelling Technology, edited by H Kronseder, of Machininenfabrik, 8402 Neutraubling, Federal Republic of Germany (a leading reference book in the art) at pages 18 and 131, where it is made clear that the correct way to mount paper labels on containers is with the direction of grain of the paper perpendicular to the axis of symmetry of the container.

In an example of the present invention, which is not to be considered as limiting the invention in any way, a method and apparatus as exemplified in UK patent application No. 8121726 were used, in which the carrier was derived from a calendered, uncoated paper having the following properties:

weight: 60 g/m$^2$;
moisture content: 7.5% at RH 50%
thickness: 52 μm;
dry tearing strength: 177 mN in grain direction, 277 mN in cross direction;
dry tearing strength ratio: 1.56
surface roughness 125 ml of air/minute.

Wrap around carriers with printed indicia and an overlapping adhesive strip were then applied to cylindrical metal containers having a suitable receptive coating (as described in application No. 8121726) in each of two ways—(1) with the grain direction of the carrier perpendicular to the axis of symmetry of the container, and (2) with the grain direction of the carrier parallel to the axis of symmetry of the container.

On heating to transfer the indicia it was noticed in the case of (1) above that the carrier wrinkled-up and became creased in various places on shrinking on to the receptive coating, but that the carrier remained perfectly flat in respect of (2). The failure of the carrier in (1) to shrink uniformly and remain flat manifest itself in the subsequent appearance of the transferred indicia when the carrier was removed. Thus, in (1) the indicia lacked clarity and sharpness and appeared dulled as if slightly out of focus, whereas by comparison, in (2) the indicia appeared sharp and clear and was judged to be of considerable aesthetic attractiveness.

Two further important differences between the traditional container labelling art and the present invention and which further serve to distinguish the invention are (1) the non-permanence of the dye transfer carrier, i.e. it is intended to be present on the container for only a relatively short time, possibly only a few seconds, and (2) the exposure of the carrier after its application to the container to heat, to cause it to shrink.

Although the present invention has, for convenience, been described with respect to decorating metal containers, the invention is clearly in no way limited thereto, since it is the presence of a receptive coating on the surface of a container that is relevant and not the nature of the material of the container itself. Thus, containers comprising non-metallic materials such as glass or plastics (for example polyesters or polycarbonates) are also envisaged.

We claim:

1. A method of decorating tubular metal containers including the steps of:

(a) applying a flexible paper carrier, printed with indicia in a sublimible dye, over a coating receptive to such dye on a surface of the container, by means of an adhesive such as to be removable without damage to the coating, and (b) heating the container whilst the carrier is held to it, at such a temperature and for such a time that the carrier freely shrinks into intimate contact with the coating and at least some of the dye sublimes so as to transfer the indicia to the coating.

in which the paper carrier has a weight of 35–110 grams per square meter, an equilibrium moisture content of 2–15% when exposed to air with a relative humidity of 50%, and is applied to the coating on the surface of the container so that the direction of grain of the paper is parallel to the axis of symmetry passing through the centre of the base of the container.

2. A method according to claim 1 in which the paper carrier has a weight of 50–100 grams per square meter.

3. A method according to claim 1 or claim 2 in which the paper carrier has an equilibrium moisture content of 4–10% when exposed to air with a relative humidity of 50%.

4. A method according to any of claims 1–3 in which the thickness of the paper carrier is from 30–100 m.

5. A method according to any one of claims 1–4 in which the ratio of the dry tearing strength of the paper carrier in the cross grain direction to that in the machine grain direction lies in the range of 1.2–2.0.

6. A method according to any one of the preceding claims in which the surface roughness of the paper carrier lies in the range of 20–500 ml of air per minute.

7. A method according to any one of the preceding claims in which the container comprises a cylindrical metal can.

8. A tubular metal container when decorated by a method according to any one of the preceding claims.

* * * * *